US007309667B2

(12) United States Patent
Schindler et al.

(10) Patent No.: US 7,309,667 B2
(45) Date of Patent: Dec. 18, 2007

(54) WOVEN FABRIC AND A METHOD FOR THE PRODUCTION THEREOF

(75) Inventors: Stefan Schindler, Esslingen (DE); Helmut Weinsdörfer, Pliezhausen (DE); Jürgen Wolfrum, Ebersbach (DE)

(73) Assignee: Deutsche Institute fur Textilund Faserforschung Stuttgart, Denkendorf (DE)

( * ) Notice: Subject to any disclaimer, the term of this patent is extended or adjusted under 35 U.S.C. 154(b) by 47 days.

(21) Appl. No.: 10/491,956

(22) PCT Filed: Oct. 10, 2002

(86) PCT No.: PCT/EP02/11340

§ 371 (c)(1),
(2), (4) Date: Oct. 13, 2004

(87) PCT Pub. No.: WO03/033795

PCT Pub. Date: Apr. 24, 2003

(65) Prior Publication Data

US 2005/0070188 A1 Mar. 31, 2005

(30) Foreign Application Priority Data

Oct. 12, 2001 (DE) ..... 101 50 207
Jun. 6, 2002 (DE) ..... 102 25 049

(51) Int. Cl.
*D03D 15/04* (2006.01)

(52) U.S. Cl. ..... 442/197; 442/189; 442/193; 442/203; 442/208; 442/209; 442/301; 57/206; 57/208; 57/238; 57/244; 57/246; 57/908; 28/104; 28/179; 28/271; 28/281

(58) Field of Classification Search ..... 442/197, 442/189, 193, 203, 208, 209, 301; 139/420, 139/383; 28/103, 104, 178, 179, 271, 281; 57/206, 208, 238, 244, 246, 908
See application file for complete search history.

(56) References Cited

U.S. PATENT DOCUMENTS 4,965,919 A 10/1990 Fujita et al.

(Continued)

FOREIGN PATENT DOCUMENTS

DE 1223335 8/1966

(Continued)

OTHER PUBLICATIONS

Patent Abstract of Japan No. 11-181642, published Jul. 6, 1999.

(Continued)

*Primary Examiner*—Andrew Piziali
(74) *Attorney, Agent, or Firm*—Dority & Manning

(57) ABSTRACT

A fabric includes mutually transverse thread systems, with at least one of the thread systems including a differential shrinkage yarn C. The shrinkage yarn C has at least one effect component A that irreversibly elongates itself upon heat treatment, and at least one shrinkage component B that shortens itself upon heat treatment. The components A and B are bound together by nodes, wherein the number (y) of nodes per meter in the yarn C is predetermined as a function of the yarn count (x) of the transverse thread system so that the number (y) of nodes exceeds a minimum value and increases proportionally above the minimum value as a function of the yarn count (x).

15 Claims, 5 Drawing Sheets

U.S. PATENT DOCUMENTS 5,688,594 A * 11/1997 Lichscheidt et al. ..... 428/370

FOREIGN PATENT DOCUMENTS

DE 19506316 8/1996
EP 0336507 10/1989
EP 0777002 6/1997

OTHER PUBLICATIONS

PCT Search Report, Mar. 5, 2003.
German Patent Office Search Report, Jan. 27, 2003.

* cited by examiner

WOVEN FABRIC AND A METHOD FOR THE PRODUCTION THEREOF

FIELD OF THE INVENTION

The invention concerns a woven fabric, wherein one of its mutual crossover threads of the thread system possesses a differential shrinkage yarn C, which is composed of first, at least one effect component A, which upon exposure to heat becomes irreversibly lengthened and second, at least one shrinkage component B which reduces its length upon exposure to heat,

BACKGROUND AND SUMMARY OF THE INVENTION

DE 3 915 945 discloses such a woven fabric which, by means of different degrees of shrinking under heat treatment of the woven yarn, exhibits a bulkiness and a warm feel along with other desirable characteristics. This is predominately true, when a combined yarn is employed, whereby one portion thereof elongates under heat and another part shrinks under the same treatment (hereafter, termed "differential shrinkage"). The feel of such a weaving is better than weavings wherein threads are used which exhibit only shrinkable properties. In the case of the latter, the efficiency of production is negatively influenced by the shrinkage of the finished yarn. The situation can become even more disadvantageous, in that looping lengthens itself upon heat exposure and thereby, threads protruding out of the said loops are troublesome in successive processing. The difficulties can include splitting of the threads or loop snags in subsequent machine-centered processes.

On this account, in this cited DE 3 915 945, provision has been made that both of the differently shrinking yarns which form multi-filament yarns be joined together by vorticular turbulence, (hereinafter, "vortexed") by means of which some 20 to 100 connecting nodes per meter are achieved. Furthermore, continuous filament threads were used for A and B, which threads, upon sizing, exhibit only a small difference in the change of length. When conventionally sized, both components show respective changes in length, whereas, in the present invention, the final length difference, brought about by the lengthening of the component A and the shrinkage of the component B, does not appear until the end of the heat treatment of the finished weave with air at a temperature of 160° C., at which time the bulkiness is also generated. In this manner, the threads, during the weaving operation are more easily manipulated than the conventionally combined threads, which shrink under heat treatment and, indeed, to different extents. The loopings, which immediately arise thereby, during the winding or the weaving, rub together and can entrap themselves in the loom equipment, whereby the woven formation and the workability of the fabric is substantially impaired.

In a case of the known procedure, limits are imposed, not only in the production, but also in the selection of the thread materials. More restrictions appear in the characteristics of the weaving, that is, in the feel of the fabric. For instance, only thread materials can be used, which, during the sizing procedure show somewhat the same shrinkage characteristics. However, the said thread material, during the end treatment of the woven fabric, must be such, that the elongation and the shrinkage so compensate one another, that the desired bulkiness is attained.

In order to assure a good, workability, vorticity becomes necessary, although the number of nodes per meter must not exceed 100, because otherwise, undesirable irregular places show up in the fabric along with a tendency for breakage of filaments of the multiple threads A.

Thus, a purpose of the present invention is to avoid these above stated disadvantages and to create a woven fabric which, both in its manufacture as well as in its properties shows an improvement above that which is now available. Additional objects and advantages of the invention will be set forth in part in the following description, or may be obvious from the description, or may be learned through practice of the invention.

Surprisingly, experience has shown, that first, the number of the vortexed nodes, by means of which the components A and B are joined, and second, the number of the mutually crossover threads of the fabric system, must be in a complementary agreement. Thereby, considerably more vortexed nodes per meter in the yarn C become possible, without impairing the appearance of the weave. By means of the said nodes, loops, which occur by differential shrinkage, are more tightly bound together. Under these circumstances, there are fewer broken filaments appearing during the processing of the weave, and also, any tendency to stretch in later use is substantially reduced.

For a fault-free working of yarn in the weaving process, neither a vortexing of the yarn nor sizing is necessary, so that, in its manufacture, the woven fabric is clearly more economical and is less sensitive to the local environment. The fabric has the advantageous characteristic, in the Martindale abrasion examination regarding judgment of which color differences in accord with a grayness-standard, show fewer color variations from the original than standard comparison samples with lesser vortical node density. The woven fabrics show fewer "flamme" outcrops (randomly thickened twists), even though the yarn has not been vortexed. The reason for this is, that by the large number of nodes, the effect-yarn component A appears as though the threads would have been vortexed. In other words, the individual filaments lie somewhat transversely positioned due to the intensive vorticity and are no longer parallel. This provides a good covering of the shrinkage components.

In accord with a particular embodiment, the number of the vortexed nodes in relation to the number of threads in the transverse thread system lies in the range of $y_{min} \geqq 98+0.7x$, wherein y=the number of nodes/meter in yarn C and x represents the number of threads per centimeter in the transverse arrangement, based on the finished woven fabric. The expression "yarn count (x)" is used throughout the present description to mean the number of threads per centimeter in the transverse thread arrangement. Therewith, advantageously, optimal conditions in regard to feel and appearance of the fabric is achieved. The woven fabric characterizes itself, not only in regard to its achieved volume, but also by the velvet-like feel brought forth by a uniformly structured surface.

By means of the features of the method according to aspects of the invention, the manufacturing costs are reduced by the elimination of the expensive sizing process and by the absence of sizing wash-out. Added to the economical measures is the elimination of reweaving of any non-vortexed yarns. Further details of the invention are described below with the aid of the attached figures.

BRIEF DESCRIPTION OF THE FIGURES

There is shown in.

DETAILED DESCRIPTION

Reference will now be made to embodiments of the invention, one or more examples of which are illustrated in the figures. Each embodiment is provided by way of explanation of the invention, and not as a limitation to the invention. For example, features illustrated or described as part of one embodiment may be used with another embodiment to yield still further embodiments. The present invention includes these and other modifications and variations to the embodiments described herein.

Figure 1:
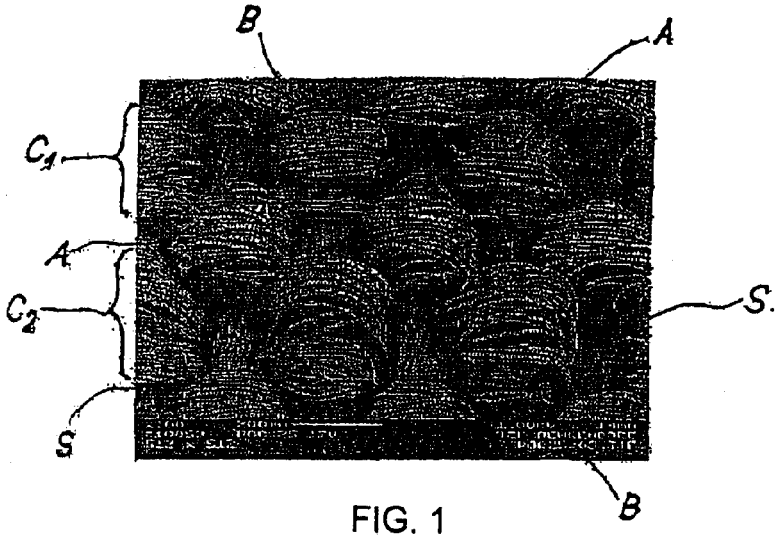
FIGS. 1, 2 enlarged photos of woven fabrics in accord with the state of the technology (Examples 1 and 2), FIG. 3 an enlarged photo of a woven fabric in accord with the invention (Example 3), FIGS. 4*a*, 4*b* enlarged photos of woven fabrics in accord with the invention with different colored filament yarns in conformity with differentially shrunk yarns (Examples 4a and 4b)

FIG. 1 shows in a large scale enlargement, a finished woven fabric in accord with the state of the technology with a differential shrinkage yarn C in the warp and a normal filament yarn S (i.e., B PET 76 dtex f 24 smooth 1000 T/m) in the weft with a density of 36 threads/cm in the finished fabric, so that a transverse yarn count comes to x=36/cm. The two yarns C and S are woven together in a linen binding. The differential shrinkage yarn C is vortexed to a relatively small number of 120 nodes per meter appearing in the finished fabric. The differential shrinkage yarn C possesses the components A and B, whereby the components A and B, to a great part lie separate from one another in the finished woven fabric. This has the result, that the shrinkage yarn B lies smoothly beside the effect component A and is not covered by component A. Further, the shrinkage component B lies very tight and straight along the weft threads S. Nearly all loopings of the effect component A are formed from parallel filaments. In spite of a difference in length of 54% at 18% elongation of the effect component A and 36% shrinkage of the shrinkage component B, the voluminous characteristic is, nevertheless, reduced in its amount. The basically smooth filaments of the shrinkage component B are scarcely covered. The resulting fabric appears to be somewhat thin. Helpful in this situation, is that in the case of the yarn $C_2$, a somewhat better covering is achieved than with the yarn $C_1$. A difference of this sort, subsequently shows itself in the finished fabric as stripes or even appears irregularly as windings with thickened intervals (flamme). This is undesirable.

The number of the vortexing nodes per meter (y=120) in this fabric is some what less than the area limit given by the formula $y_{min}$=98+0.7x. In order to reach a value of y>98+0.7x, then either the number of the vortexed nodes must be raised to more than 123/m, or the number of the weft threads S must be reduced from 36 to less than 31.4. The latter, however, results in a weave of poorer quality, so that raising the number of the vortexing nodes becomes the preferred choice.

Figure 2:
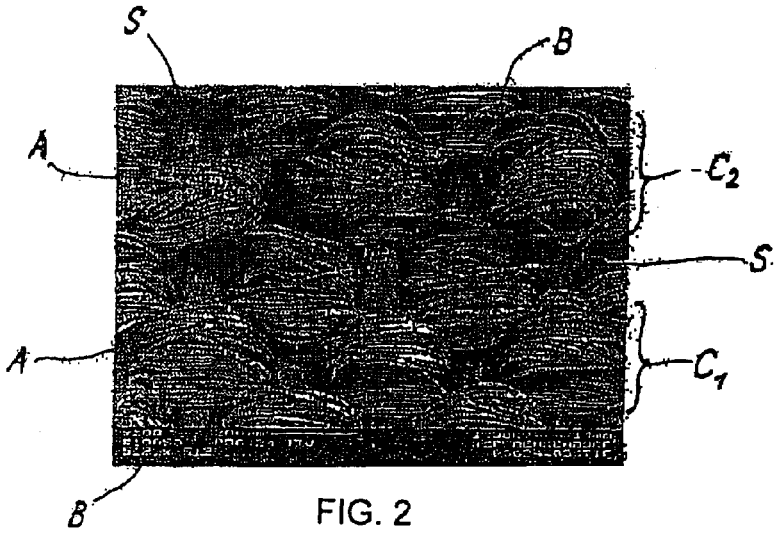

FIG. 2 shows a large scale enlargement of a finished woven fabric in accord with the state of the technology, with the same parameters as Example 1 in FIG. 1, with the exception, that the number of the vortexed nodes in the differential shrinkage yarn C are still fewer, namely 108/meter in the finished fabric. Even here the shrinkage component B lies free and is not covered by the effect component A, wherein the covering is also different. Although in the case of C2, the covering is better, the shrinkage components B, in the case of C1, lie free and parallel to the effect components A. The woven fabric, as taught by Example 1, cannot be used.

The number of the vortexed nodes per meter (where y=108) lies below the area defined by the expression $y_{min}$=98+0.7x. In order to achieve a y-value above the specified $y_{min}$=98+0.7x line, the requirement is, that either the number of the vortexed nodes must be raised in the finished fabric above 123/m, or the number of the transverse threads S must be reduced from 36 to less than 14.3. The latter, however, does not offer a high quality fabric, so that one is limited to the increase of the number of vortexed nodes.

Figure 3:
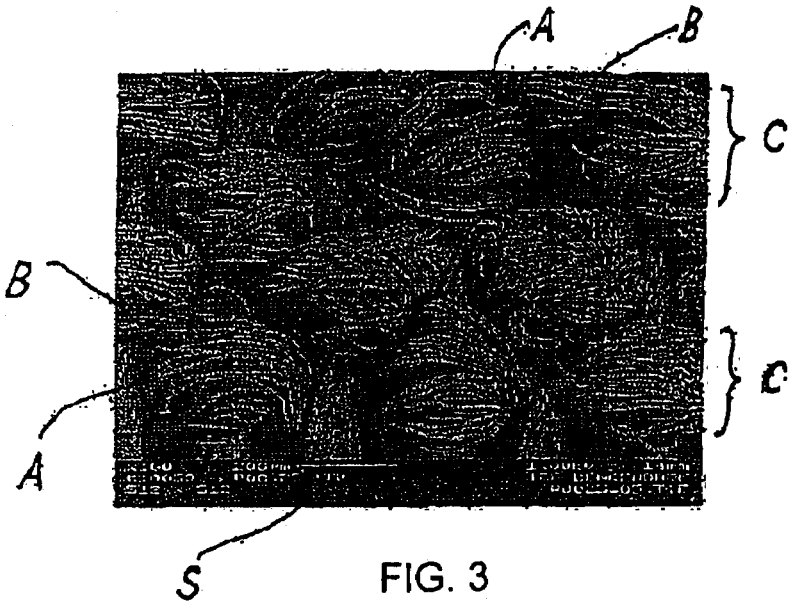

In FIG. 3, the yarn C is intensively and uniformly vortexed with its components A and B, giving 175 nodes per meter in the finished fabric. The number of the transverse threads (weft threads S) is about 36/cm. The effect component A, with its elongation factor of 18%, covers the shrinkage component B from a 36% shrink in the finished fabric up to a much higher percentage. The effect components A are visible and almost exclusive in the weave and tend to extend themselves out of the woven background. By means of the considerable density of nodes, what is also attained, is that the filament loopings have a durable property because of the close connections. As a whole, a uniform and fine structure is created, although the differential shrinkage yarn C does not differentiate itself from the shrinkage and elongation characteristics of the differential shrinkage yard C of the Examples 1 and 2. Further the weft threads S are covered more satisfactorily, so that the woven fabric appears finely structured and has a good volume.

By means of additional twisting of the differential shrinkage yarn C following the general vortexing, the fabric appearance in accord with FIGS. 1 an 2 is somewhat improved so that it approaches the illustration of the fabric in FIG. 3. That is to say, the shrinkage component B is somewhat better covered. However, in this case, the additional and very expensive work step of the said twisting is not necessary, and can be omitted, if care is taken during the vortexing of the components A and B, that the vortexing reaches a node count per meter of more than $y_{min}$=98+0.7x. With this procedure, however, there is no assurance, but that the shrinkage components B lie partially free.

Figure 4A:
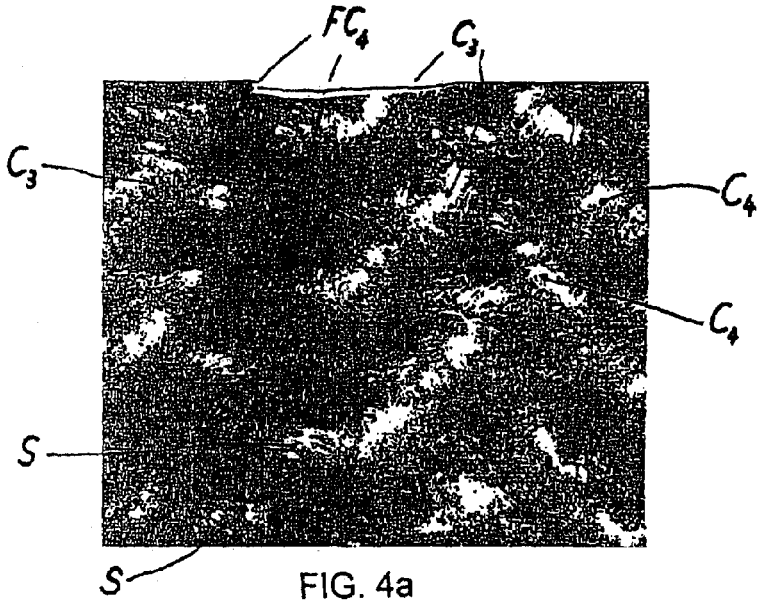
Figure 4B:
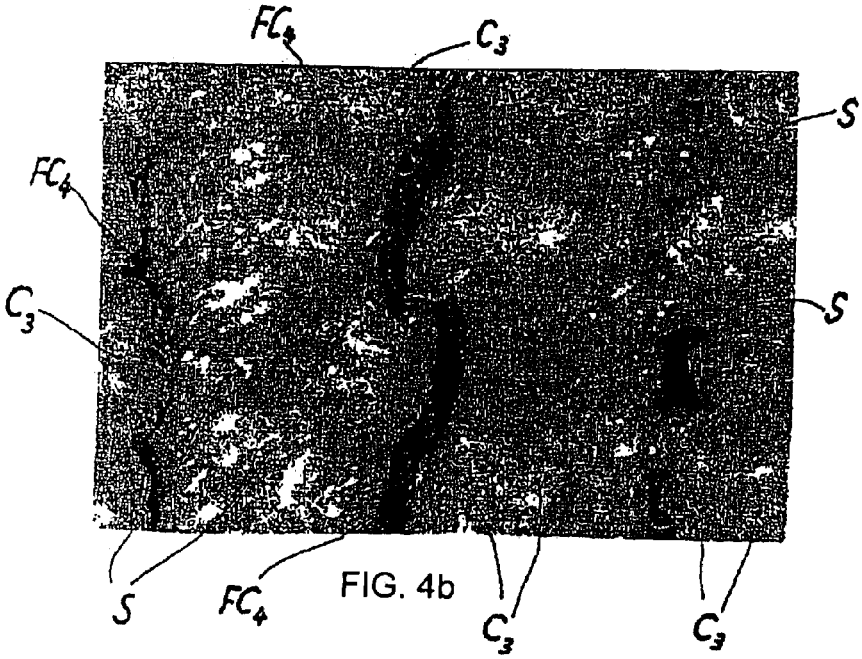

The FIGS. 4*a* and 4*b* (Examples 4a, 4b) show woven fabrics with a high vortex-node number, so that the condition y>98+0.7x, as seen in Example 3, is fulfilled.

For an examination, colored differential shrinkage yarns are placed in the warp and in a uniform exchange with the uncolored differential shrinkage yarn C. In the Examples 4a and 4b, following 6 uncolored differential shrinkage yards C, are placed two black shrinkage yarns $FC_4$, which additionally are provided with a Z-twist, while the shrinkage-yarns possess a partial S-twisted ($C_3$) as well as a Z-twisted ($C_4$). Thereby, a certain pattern effect is achieved. The woven fabric in FIG. 4*a* is in a linen binding, and that in FIG. 4*b* is in a crepe arrangement, which is woven into the weft threads S. For the two Examples in FIGS. 4*a* and 4*b*, the differential shrinkage yarn C3, C4, satisfy the formula $$y>98+0.7x.$$

The shrinkage of Example 4a showed 29%, that of Example 4b, 15%. The number of the vortexed nodes runs in the Example 4a at y=168 and in Example 4b, the corresponding value is y=150. The number of the transverse threads in Example 4a shows x=41 and in Example 4b, the same is x=37.

| | |
|---|---|
| For 4a: | $168 \geqq 98 + 0.7 \times 41$ |
| | $168 \geqq 127$ |
| For 4b: | $150 \geqq 98 + 0.7 \times 37$ |
| | $150 \geqq 124$ |

By means of the high vortexed-node density of the differential shrinkage yarn C in the Examples 4a, 4b, the achievement is, that the filament looping has a satisfactory durability as a result of the close bindings. The shrinking component B in Example 4a is 29% in the finished fabric and is completely covered by the effect component A, which has elongated itself by 15%. Created is a uniform and fine structure of the woven fabric surface, which is interrupted for patterning by non-colored and colored yarns. The woven fabric appears, generally, finely structured and voluminous. In the case of the Example 4b the length difference of the differential shrinkage yarns in the finished weave achieve some 30% by approximately the same value of elongation of the component A and the shrinkage of the component B, which run, approximately about 15%. A length difference of the shrinkage component B and effect component A of the differential shrinkage yarn C of at least 25% in the finished fabric is necessary, in order to obtain the desired feel, as well as to achieve softness, functionality and the appearance of a natural fiber. In principal, it is possible to produce these differences in length from numerous combinations of yarns which differently shrink or extend themselves for different causes.

Yarns with elongation possibilities have very low tensile strengths and upon being stretched, even lose this inherent property of self lengthening. This characteristic must be given consideration, especially in the case of selecting yarn components for a differential shrinkage yarn.

A combination-yarn, which consists only of components with a capabilities for elongation, would not be advisable for use in the manufacture of a fabric. In order to assure sufficient tensile strength for continuous fabric manufacturing, at least one of the yarn components of the differential shrinkage yarns C should be of high strength.

The shrinkage of a normal, conventional, standard, polyester yarn lies in the range of 3 to 10%. Such a yarn would not be designated as a shrinkage-yarn, although is does shrink to a certain degree. A polyester yarn with a low shrinkage value is called a "poor shrink" yarn. A polyester yarn with a shrinkage of more than some 10% can serve as a shrinkage yarn. A polyester yarn with a shrinkage of more than 20% can be designated a "high shrink" yarn. In the case of polyester yarns, however, shrinkages of as much as 60% can be attained.

The greater the amount of shrinkage of the component B in the case of the structure of a woven fabric, just that much greater is the change in the dimensions of the fabric. Dimension changes which are too great, lead to problems in the workup of the structure, because the machines are not designed for extreme longitudinal or width shrinking values. Beyond this, excessive dimension changes can only be approximately precalculated. Further, a shrinkage of 50% would yield a very coarse structure, even in the case of such threads being applied in the weft to achieve unusual widths. That is to say, this would require unusually wide looms. In addition, the weave must be made, because of the extreme density of the fabric, with a very low yarn count, a practice which, in the technology of weaving, is not simple, because very light adjusted weavings allow unwanted thread displacement.

Because of these many disadvantages, a particularly marked looping effect can be achieved, namely a large elongation difference of the two components of the differential shrinkage yarn coacting with an ability to bring about the largest possible elongation of the component A. The elongation of the component A leads to no dimensional change in the woven fabric. In the case of polyester yarns, extension values up to 30% can be achieved. The remainder of the looping effect must be gained by a shrinkage of the shrinkage component B, which is sufficient but is not too high. This is to be seen as carried out in the Examples 4a and 4b. In any case, this has its limits, since a poor-shrink yarn with a shrinkage near 0% is very difficult to color. Experience has shown that the best effects in regard to the formation of looping, of the feel characteristics and the above cited disadvantages lie in shrink-components having a shrinkage range of 10 to 30%.

In the Example 4a, a cottony feel or a sensation of thickness is attained by an elongation of the effect component A of 15% and a shrinkage of the shrinkage component B of 29%. In the Example 4b, where an elongation of the effect-component A of 15% and a shortening of the shrinkage component B is present, then a crepelike, thick handling feel is attained, which can be further reinforced by an elastic weft yarn.

Figure 5A:
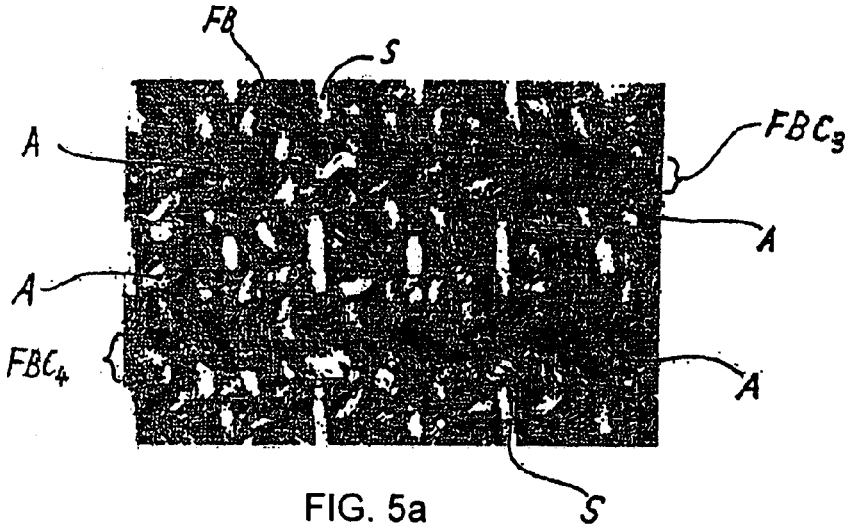
FIGS. 5*a*, 5*b* enlarged photos of woven fabrics with differently colored components of the differentially shrunk yarn (Examples 5a and 5b), FIG. 6 an enlarged photo of a woven fabric in accord with the invention, however, made with a light vortexing of the differentially shrunk yarn (Example 6), FIG. 7 a schematic representation of the differentially shrunk yarn, following the removal of the differential shrinking effect, and FIG. 8 a diagram of the dependency of the number of nodes to the density of the threads in accord with the invention.
Figure 5B:
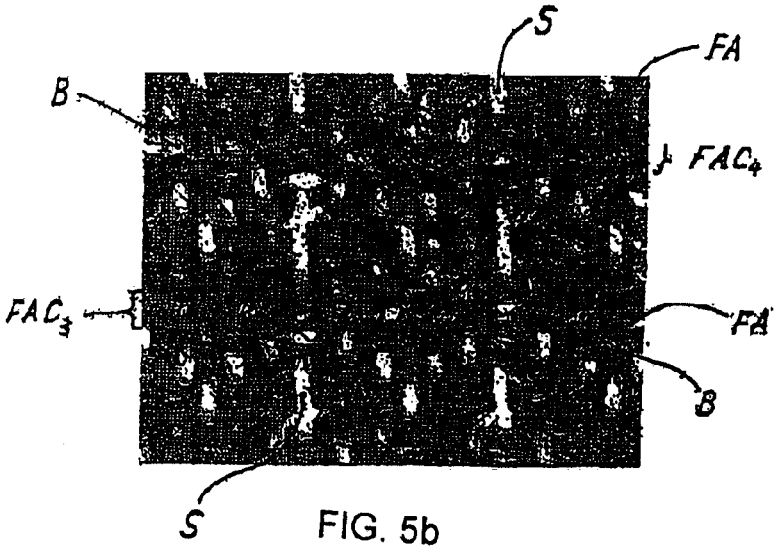

In the FIGS. 5*a*, 5*b*, (Examples 5a, 5b) a pattern is brought out by the weave-bindings, the differently colored yarn components, and different vortexing of the differential shrinkage yarn. As a weft yarn S, respectively, a non-colored filament yarn is employed. In FIG. 5*a*, the differential shrinkage yarns, namely C3 and C4 possess as shrinkage-components FB, a black colored filament yarn, while the self elongating, effect-component A remains as uncolored filaments. In the finished fabric, the differential shrinkage yarns $FBC_3$ and $FBC_4$ fulfill the conditions stated as $y \geqq 98+0.7x$, where the number of the vortexed nodes in the finished fabric run y=139 and the number of transverse threads per centimeter can be expressed as cross threads/cm=32.6. In FIG. 5*b*, the differential shrinkage yarns $C_3$ and $C_4$ possess a non-colored filament yarn serving as shrinkage component B, while the self elongating effect component FA is made of a black colored filament. In the finished woven fabric, these differential shrink yarns $FAC_3$ and $FAC_4$ fulfill the conditions for $y \geqq 98+0.7x$, whereby the number of the vortexed nodes in the finished fabric run y=170 and the number of cross threads runs per centimeter at the value of 32.6.

A woven fabric can be made with the characteristics of the fabric shown in Examples 3 or 4, but which would also offer a color effect such as gray shadings and structure effects. By the very high number of nodes of y=139 or y=170, these weavings are particularly favored as to their appearance and feel. Additional patterned effects are made by an exchange between Z-twisted ($C_4$, $FAC_4$, $FBC_4$) and S-twisted ($C_3$, $FAC_3$, $FBC_3$).

Figure 6:
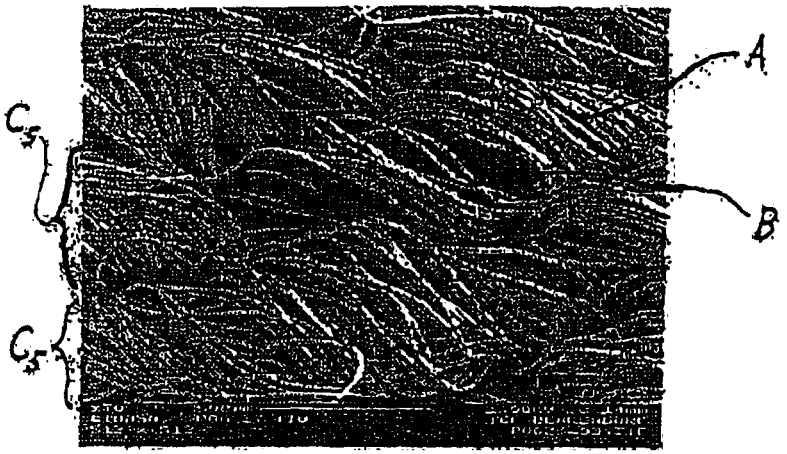

In FIG. 6 (Example 6) is exhibited a coarse differential shrinkage yarn C5 of fineness 555 dtex with its components A and B intensively and uniformly vortexed with 127 nodes per meter into the finished fabric. The transverse yarn count x runs 17/cm in the finished fabric. The elongated effect components A cover the shrinkage component B very completely. What is visible, is nearly exclusively the effect components A which emerge from the base of the weaving. Because of the large node-density, besides the above, what is achieved is, that the filament loopings exhibit a good durability due to the close connections. Even the weft threads were covered, so that the weave appears finely structured and voluminous. As a whole, there is produced a uniform and fine structure. It is possible to achieve, in the case of this example, by means of a small amount of additional twisting of the differential shrinkage yarn $C_5$ with only 300 T/min, that the weave surface is still more uniform and the shrinkage component B is even better covered. If there were a lesser node count, such as $y>98+0.7x$, then, even with an additional vortexing of the differential shrinkage yarn of at least 500 T/m, a weaving of this kind could not be achieved. A weaving of greater count can be used as seat covers in an automobile.

The elongation of the effect component A to 18% in the finished fabric has somewhat the magnitude of the shortening of shrinkage component B, so that again in this case, the advantage of a small production loss by the shrinkage and a better adherence to a true shape of the fabric is achieved.

Figure 7:
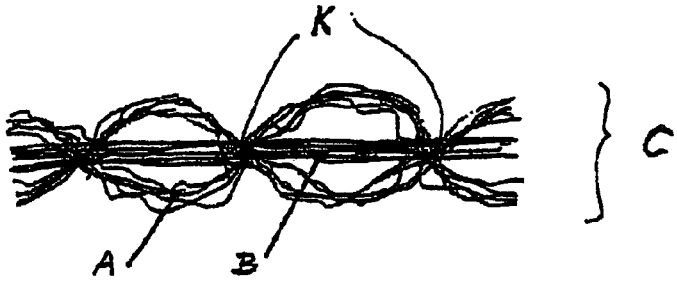

In FIG. 7, the construction of the differential shrinkage yarn C is schematically shown.

In the case of the heat treatment of the yarn C in the finished fabric, the differential shrinkage is freed, that is, the component A elongates itself, while the component B shrinks, and on this basis, the two lie stretched in the differentially shrunk yarn C. The two components A and B are bound together at the vortexed nodes K. If the number of the vortexing nodes K lies in a range above $y_{min}$, then the result is improved to the extent, that well bound loops with good durability and uniformity are generated. When this yarn is present and in use, the filaments of the yarn component A, upon the freeing of the elongation by heat treatment of the woven fabric, form texture influencing microloops, thus improving the feel and the functional characteristics of the fabric. The surface structure has a pleasing volume and has a dry, soft and delicate feel. In accord with the fineness of each filament and yarn, effects such as "peach skin", velvet, silk, linen wool or cotton can be achieved. It is also possible, that by a light twisting of the differential-shrink yarn C and alkalization, a thick, crepelike character can be imparted. Beyond this, the criteria for clothing fabrics, which must avoid shrinkage from ironing, from washing, as well as having a resistance against tearing, stretching, or abrasion, are particularly well fulfilled.

Figure 8:
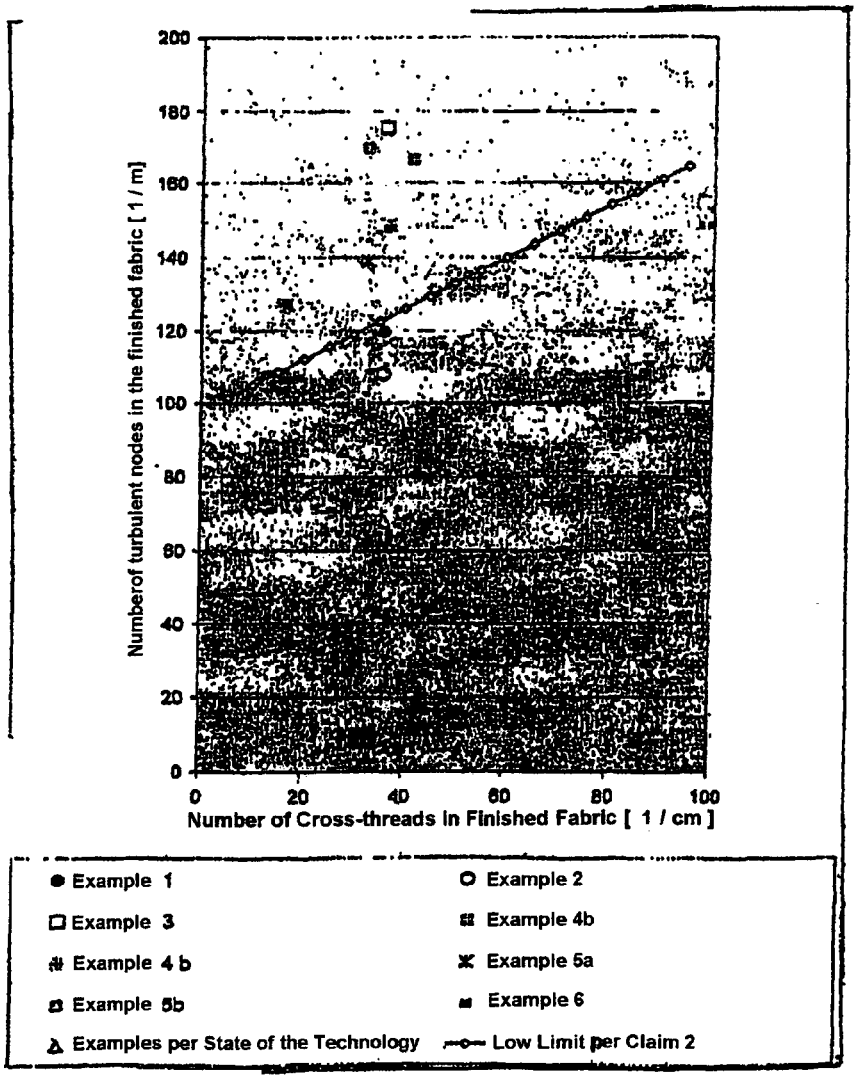

FIG. 8 is a graphic presentation of the relationship in the finished fabric between the number of the vortexed nodes per meter and the transverse thread density per centimeter. Let y stand for the number of vortexed nodes, while x represents the transverse thread density. The straight line $y_{min}=98+0.7x$ defines the limit between that area in which, in accord with the invention, by means of intensive vortexing according to the thread density, a woven fabric can be created, having uniform and voluminous surface structure and characterized by high quality and satisfactory feel.

The determination of the values for x and y on the finished fabric is carried out in the following manner. First the thread density (yarn count/cm x) in the weft and warp directions is determined in accord with known methods, that is, by the counting with a yarn counter or by means of enlarged photographic reproductions. For the determination of the vortexed nodes per meter, the differential shrinkage yarn C is removed from the finished fabric. Insofar as the differential shrinkage yarn C has been subjected to a twisting, then this twisting is set back to zero. This can be carried out by a twist-meter. On the now untwisted differential shrinkage yarn C, the vortexed nodes per meter are determined thereby, in that either manually with a needle, vortexed points are identified, and their separating distances recorded, or the determination can be made with a test apparatus, such as is available from "Reutlinger Interlace Counter RIC" which probes the differential shrinkage yarn and thus counts the number y of the vortexed nodes per meter. The so determined values of the numbers for x and y are then entered into the equation $y \geqq 98+0.7x$ in order to determine the zone for a given woven fabric.

The particular advantage of this intensive vortexing and thereby, the resulting connections between the two components A and B of the differential shrinkage yarn C, lies therein, in that a quality and an appearance are created, which could not be attained by any subsequent twisting procedures.

The reason for this is that during its being vortexed, the thread also increases in diameter, thus becoming thicker. Another advantage is that both sizing and the washing out of the said sizing can be eliminated. When sized, in accord with the conventional means of manufacture, the threads cannot be processed thereafter, or at least, further processing can only be carried out with great difficulty. Since it possesses differential shrinkage, the yarn C as previously indicated, is limited to heat treatment in the equipment, while otherwise, the components A and B can be mutually made ready for a heat treating process which takes place on the finished fabric. If sizing is eliminated, then no particular consideration need be taken in regard to holding necessary sizing temperatures. This considerably simplifies the process and excludes the possibilities of error. Also, this simplification is a basis for a desirable, more uniform fabric structure. If one additionally takes care, that the produced bulkiness is gained to the largest extent by means of a large elongation of the effect components and at the same time, only a small diminution of the shrinking component occurs, then, on this basis, not only an essential improvement of the productivity is attained, but the precision of the finished shaping is assured.

In FIG. 8, that above elucidated examples are displayed in graphic form. From the pictures of weaving, i.e., FIGS. 1 to 6, it becomes obvious, which weaving structures lie above and below the threshold line of $y_{min}=98+0.7x$.

The fabric wares obtained in accord with the invention are acceptable in the clothing industry, as well as service for domestic textiles, especially for pillow and cushion ware. Further uses can be found in the field of semi-technical textiles, namely medicinal as well as textiles in demand for abrasion resistance and light weight such as textiles used in automobile seat covers. The high degree of crystallinity of the differential-shrinkage yarn in the finished fabric leads to an extraordinarily high resistance to incident light. A lessening of a tendency of the fabric to become soiled can be arrived at by the usage of fine to finest filaments (single filaments<1 dtex) for the A effect-component.

In the case of the described examples, the differential-shrinkage yarn C is employed as a warp yarn. Naturally, it is possible that the differential-shrinkage yarn C can also be woven as the weft threads S or as combined weft and warp weaving. Should other threads be laid between the threads with differential shrinkages, then, it is possible, that by means of appropriate exchange between differential shrinking yarns and other yarns, definite effects can be created in the final fabric. In this case, yarns, for example, without differential shrinkage can even serve as yarns with "other" differential shrinkages. In this way fabric designs can be created, since the interwoven threads can be laid in appropriate pattern creating positions. In this way, stripes, diamond shapes, crepe effects or a waffle pattern can be made, as are described in the Examples 4a, 4b, 5a, 5b and illustrated in the FIGS. 4*a*, 4*b*, 5*a*, 5*b*.

In order to produce a favorable bulkiness and voluminosity, then a differential-shrinkage yarn C is to be used, wherein the difference in lengths between the two components A and B in the finished fabric amount to at least 25%. In the case of the looping produced thereby, the said intensive vortexing is of substantial importance for a fault-free, smooth running operational process. The weaving possesses, in spite of a large bulkiness, good duration and resilience, particularly to abrasion. This is to be credited to the intensive binding of the effect components A by means of the high number of vortexed nodes.

The production of the finished woven cloth is done in such a manner, that components A and B were selected for the differential shrinkage and these being vortexed together with a node number of y>98+0.7x. Thereby, following this particular vortexing, no other vortexing or twisting processes are necessary in the weaving works. This does not, however, exclude, that for the purpose of patterning or for the improvement of the feel of the fabric, the differential shrinkage yarn C cannot undergo an additional twisting, as has been described above. Such individual vortexing or twisting can be adjusted to the desired properties and patterning. The differential shrinkage yarn can be used immediately after the vortexing for the making of the warp and need not be sized. The so constructed warp is then combined with the weft threads S and the resulting fabric is thermally treated in the machine. In the case of this heat treatment, the differential shrinkage is freed, to make the finished fabric as described above.

It is possible, that instead of the weft threads S, a differential shrinkage yarn C can be used. A twisting or turning under these circumstances would not be necessary. However, if ware of high value is concerned, then certain attendant extra costs of such twisting could be considered as justified and as well, the covering effect, feel of the fabric, and the drape properties can be optimized. With preliminary intensive vortexing, fewer of these expected twists would be necessary. In comparison to conventional yarn twisting, of some 1000 to 3000 twists per meter for yarn of the fineness of 600 dtex to 40 dtex, it is possible with the said preliminary vortexing, to allow about half of the yarn twist count, to achieve an effect regarding both ease of workability, as well as fabric reject losses. Thus, the yarn twisting may also improve the covering effect, which exists with conventional manufacture, which includes sizing and necessity for a greater yarn twisting. The yarn vortexing may well overstep the covering effect and can, in any case, reduce the volume of the yarn, since the said yard is compressed during vortexing. The above costly procedure need not take place where yarn connection is made by vortex engagement. Both the covering effect as well as the volumes are improved by the high number of yarn connections made by turbulent vortices.

The differential shrinkage is activated the best manner, after the weaving and during the heat treatment of the woven fabric.

The heat treatment of the fabric is advantageously of 2 stages. In the first stage, a treatment with water at a temperature of normally some 90° C. is carried out. In the second stage, the fabric is subjected to an essentially higher temperature of normally 180° C., which is produced by heated air. This two-stage heat treatment has the advantage, that a thermo-fixation occurs and that also, the yarn shrinks completely, so that further heat treatments, particularly in the case of coloring, will have no negative influences on the fabric itself.

Where treatment with hot water is concerned, one the one hand, the shrinkage of the shrinkage-component B is activated, and otherwise, the effect component A simultaneously develops a part of the totally possible thread elongation. In the said treatment with heated air (120–220° C.) a further thread elongation takes place on the effect component A, and the fabric is now fixed. Normally, the fabric is treated with lye after the activation of the shrinking and heat fixation, in order that a partial, chemical degradation of the PET filaments can take place for the reduction of weight and for improving the characteristics of feel, achieving a bright finish and acting to install functional properties as to humidity pickup and moisture transport of the fabric. In connection hereto, it is common at this point for a retro-fix of the fabric. Because of the large, generated volumes and the outstanding fine loop structure of the fabric, in accord with the method for manufacture as set forth in the invention, the described alkaline treatment can be omitted.

Natural leather surfaces are enriched by an added roughing or abrasive means, with which the surface of a fabric may be roughened.

The self-elongating yarn, or finished fabric, can be made from standard PET-filament, from antimony free filaments or from antimony-poor PET filaments. It is noteworthy, that in the case of carrying out reduction in an alkaline state, no antimony migrates into the waste water, which is especially advantageous for environmental protection. Commercial sources exist for fire preventing filaments, such as would be recommended for domestic fabric services and for automobile use, or even cationic polyesters for the purpose of simple coloring.

It should be appreciated by those skilled in the art that modifications and variations can be made to the embodiments described herein without departing from the scope and spirit of the invention as set forth in the appended claims.

The invention claimed is:

1. A fabric, comprising:

mutually transverse thread systems, wherein at least one of said thread systems includes a differential shrinkage yarn C;

said shrinkage yarn C comprising at least one effect component A that irreversibly elongates itself upon heat treatment, and at least one shrinkage component B that shortens itself upon heat treatment;

said components A and B bound together by nodes formed by vortical turbulence;

wherein in said fabric the number (y) of said nodes per meter in said yarn C is predetermined as a function of the yarn count (x) of the transverse thread system so that the number (y) of said nodes exceeds a minimum value and increases proportionally above said minimum value as a function of the yarn count (x); and wherein the number (y) of nodes per meter as a function of yarn count (x) is expressed as follows:

$$y(\min) \geqq 98+0.7(x)$$

wherein, relative to the finished fabric:

the node number per meter in said yarn C is "y", and the yarn count per centimeter is "x".

2. The fabric as in claim 1, wherein said differential shrinkage yarns C are woven as warp yarns.

3. The fabric as in claim 1, wherein said differential shrinkage yarns C are woven as warp and weft yarns.

4. The fabric as in claim 1, wherein other threads are interposed between said differential shrinkage yarns C.

5. The fabric as in claim 4, wherein said interposed threads are arranged in a pattern.

6. The fabric as in claim 1, wherein the difference in length between said components A and B in the finished fabric is at least 25%.

7. The fabric as in claim 6, wherein the magnitude of shrinkage of component B in the finished fabric is in a range of about 10% to about 30%.

8. A method for production of a fabric of mutually transverse thread systems, wherein at least one of the thread systems includes a differential shrinkage yarn C, the shrinkage yarn C having at least one effect component A that irreversibly elongates itself upon heat treatment, and at least one shrinkage component B that shortens itself upon heat treatment, said method comprising:

intertwining the components A and B as nodes in the differential shrinkage yarn C by means of an air blast engendered vortex such that, in the finished fabric, a minimum number (y) of nodes per meter in the differential shrinkage yarn C is expressed as $y(min) \geqq 98 + 0.7(x)$;

weaving the multi-noded yarn C as a warp yarn without sizing with a weft yarn (S), wherein in the finished fabric the weft yarn (S) has a yarn count (x) per centimeter; and heat treating the fabric after said weaving.

9. The method as in claim 8, wherein the difference between elongation of the effect component A and shrinkage of the effect component B is determined by the longest possible elongation of the effect component A.

10. The method as in claim 8, comprising combining various different differential shrinkage yarns in a pattern in at least one of the thread systems.

11. The method as in claim 8, wherein said heat treating comprises a two-stage heat treatment for activation of the differential shrinkage yarns.

12. The method as in claim 11, wherein the fabric is conducted through water at a temperature of at least 60° C. and subsequently exposed to air at a temperature of at least 120° C.

13. The method as in claim 11, wherein the fabric is conducted through water at a temperatue of at least 90° C. and subsequently exposed to air at a temperature of at least 180° C.

14. The method as in claim 8, further comprising treating the fabric with a lye solution subsequent to said heat treating.

15. The method as in claim 8, further comprising roughening the surface of the fabric subsequent to said heat treating.

* * * * *